US005748061A

United States Patent [19]

Tsutsui et al.

[11] Patent Number: 5,748,061

[45] Date of Patent: May 5, 1998

[54] ELECTROMAGNETIC RELAY

[75] Inventors: Kazuhiro Tsutsui; Seiji Imamura, both of Kyoto, Japan

[73] Assignee: Omron Corporation, Kyoto, Japan

[21] Appl. No.: 780,811

[22] Filed: Jan. 9, 1997

[30] Foreign Application Priority Data

Jun. 9, 1996 [JP] Japan ..... 8-001369

[51] Int. Cl.[6] ..... H01H 51/22

[52] U.S. Cl. ..... 335/83; 335/78; 335/85; 335/86

[58] Field of Search ..... 335/78–86, 124, 335/128

[56] References Cited

U.S. PATENT DOCUMENTS 4,745,382 5/1988 Dittmann ..... 335/78

5,038,122 8/1991 Nakayama et al. ..... 335/78

*Primary Examiner*—Lincoln Donovan

*Attorney, Agent, or Firm*—Morrison & Foerster LLP

[57] ABSTRACT

An electromagnetic relay has low heat transmission from the electromagnetic block to the contacts and a conductive circuit would have low electrical resistance. In the relay, a movable contact terminal is caulked to a yoke with a flat protruding segment between them to act as a spacer to reduce the heat transmission. The relay may also have a movable contact terminal and a movable hinged spring fixed to the yoke of the electromagnetic block. The hinged spring may then be directly electrically connected to the movable contact terminal which is fixed to the yoke to lower the electrical resistance.

6 Claims, 10 Drawing Sheets

ELECTROMAGNETIC RELAY

BACKGROUND OF THE INVENTION

The invention is directed to an electromagnetic relay.

An example of an existing electromagnetic relay is shown in FIGS. 9(*a*), 9(*b*) and 10. A fixed contact terminal 1 and a coil terminal 2 are pressed into a base 3, onto which an electromagnetic block 4 is placed.

A coil 4*a* is wound around a spool 5, which has two outer rims 5*a* and 5*b* on its opposite ends. The electromagnetic block 4 is electrically connected to the wire drawn out of the coil 4*a* by being soldered to a linking terminal 5*c* on the outer rim 5*b* of the spool 5. A core 6, which has a T-shaped cross section, goes through the opening in the center of the spool 5. On one of the protruding ends of the core 6 is a magnetic pole 6*a*. The other end of the core 6*b* is caulked to the vertical portion of a yoke 4, which is bent so that its cross section forms an L-shape.

On the horizontal portion of the yoke 4*b*, a movable armature 8 is supported by an upside-down L-shaped, hinged spring 7, in such a way that the armature 8 is free to move. A movable contact terminal 4*c* is caulked to the lower end of the vertical portion of the yoke 4*b*. Another movable contact 7*b* is on the free end of armature 7*a*, which extends from the end of the hinged spring 7. On outer rim 5*a* of the spool 5 is a fixed contact terminal 9 having a fixed contact 9*a* on its end.

The movable contact terminal 4*c* and fixed contact terminal 9 of the electromagnetic block 4 are inserted and fixed into the terminal openings in the base 3. A linking terminal 5*c* is electrically connected to the coil terminal 2 by means of solder lump 5*d*. The movable contact 7*b* faces the two fixed contacts 1*a* and 9*a* in such a way that it can alternately be brought into contact with either one while being separated from the other. Therefore, when no voltage is applied to the coil 4*a*, the spring force of the hinged spring 7 will cause the movable contact 7*b* on the armature 7*a* to touch the first fixed contact 1*a*.

When voltage is applied to magnetize the coil 4*a*, the movable armature 8 will be drawn to the pole 6*a* of the core 6 in opposition to the spring force of the hinged spring 7. The movable contact 7*b* will move away from the first fixed contact 1*a* and come into contact with the second fixed contact 9*a*, and the armature 8 will adhere to the pole 6*a* of the core 6.

When the coil is no longer magnetized, the spring force of the hinged spring 7 will cause the armature 8 to move in the opposite direction and return to its original position. The movable contact 7*b* will move away from the second fixed contact 9*a* and will again meet the first fixed contact 1*a*.

In the electromagnetic relay described above, the movable contact terminal 4*c* is caulked directly to the lower portion of the vertical surface of the yoke 4*b*. This means that a large portion of the surface area of the movable contact terminal 4*c* must adhere to the yoke, so there can only be a short distance between the yoke 4*b* and the lower end of movable contact terminal 4. When the user puts a connector on the movable contact terminal 4*c* of the electromagnetic relay and the block 4 heats up, the heat will be transferred to the connector via the movable contact terminal 4*c*, and the connector may experience a temperature which is beyond its permitted range.

Furthermore, in the relay described above, the movable armature 7*a* is electrically connected to the movable contact terminal 4*c* by way of the yoke 4*b*. Generally, the magnetic material chosen for the yoke 4*b* is iron, however, because iron has low conductivity, the resistance within the conductive circuit will be high.

SUMMARY OF THE INVENTION

The invention provides an electromagnetic relay structure having a spacer between a yoke and an external connection terminal, and a hinged spring directly fixed and electrically connected to a movable contact terminal which is fixed to the yoke.

The invention provides an electromagnetic relay having an electromagnetic block that is less likely to transmit heat, as well as a conductive circuit having low electric resistance. The electromagnetic relay includes an external connector terminal that is fixed to the yoke of the electromagnetic block, but is separated from that block by a spacer to isolate heat transmission. The relay may also have a movable contact terminal and a movable hinged spring fixed to the yoke of the electromagnetic block. The aforesaid hinged spring is then directly electrically connected to the movable contact terminal which is fixed to the aforesaid yoke to lower the electrical resistance.

Other features and advantages will become apparent from the following description, including the drawings, and from the claims.

BRIEF DESCRIPTION OF THE DRAWINGS

FIG. 7(*b*) is a cross section of the hinged spring.

FIG. 9(*b*) is a front cross section of a prior art electromagnetic relay.

DETAILED DESCRIPTION OF THE INVENTION

Figure 1:
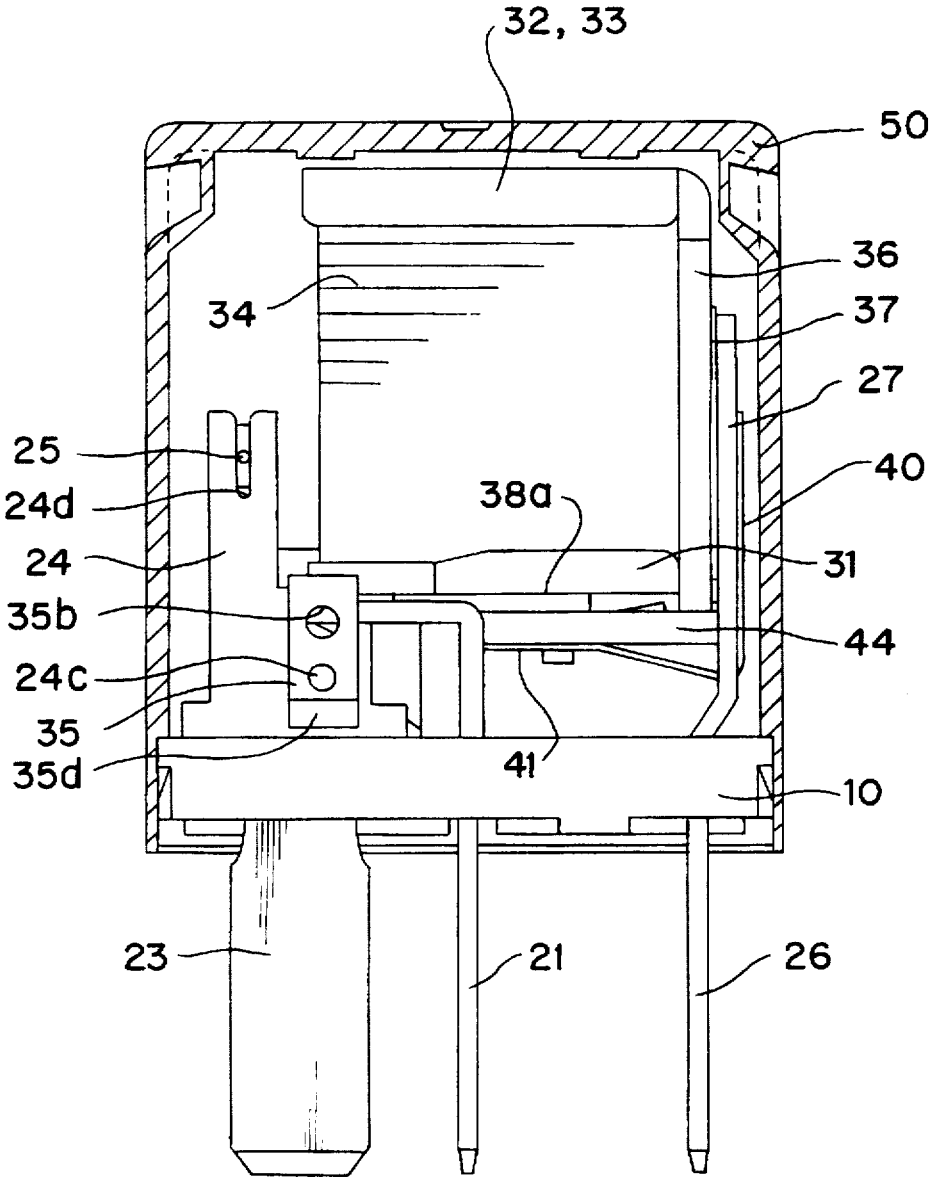
FIG. 1 is a frontal cross section of an electromagnetic relay of the invention.
Figure 2:
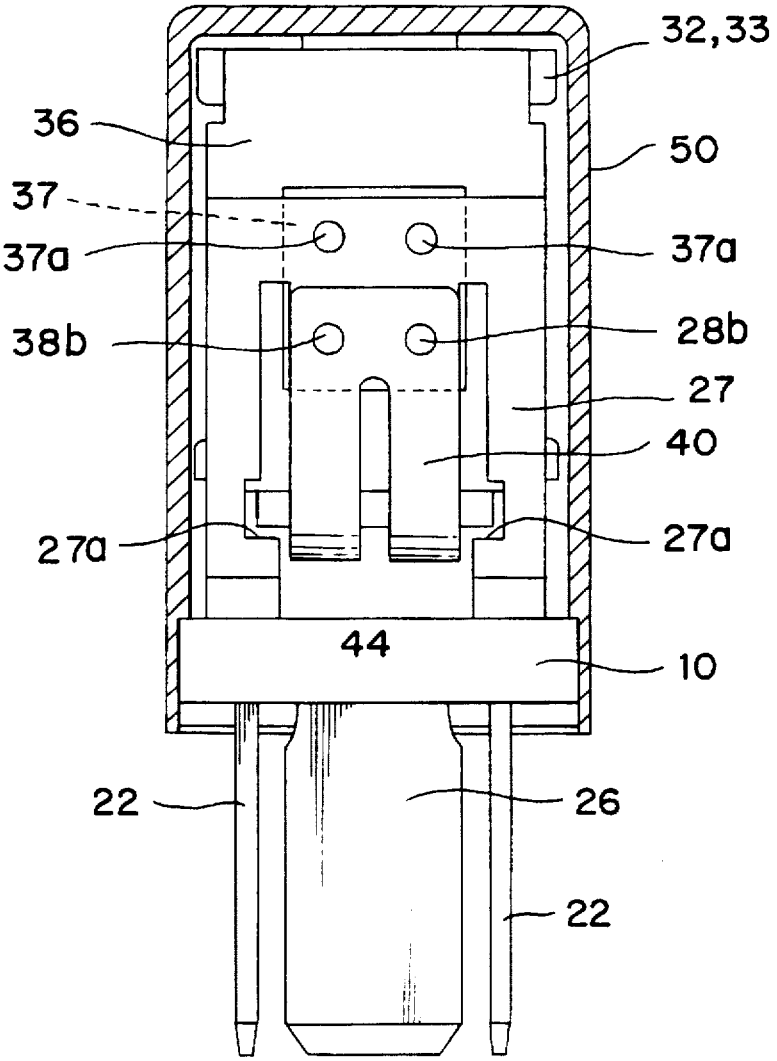
FIG. 2 is a lateral cross section of an electromagnetic relay of the invention.

Referring to FIGS. 1 and 2, an electromagnetic relay includes fixed contact terminals 20 and 21 and coil terminals 22 that are firmly attached to a base 10. The electromagnetic relay further includes an electromagnetic block 30 that is formed integrally with movable contact terminal 26, a movable metal armature 44 that is formed integrally with hinged spring 40 and a case 50.

Figure 3:
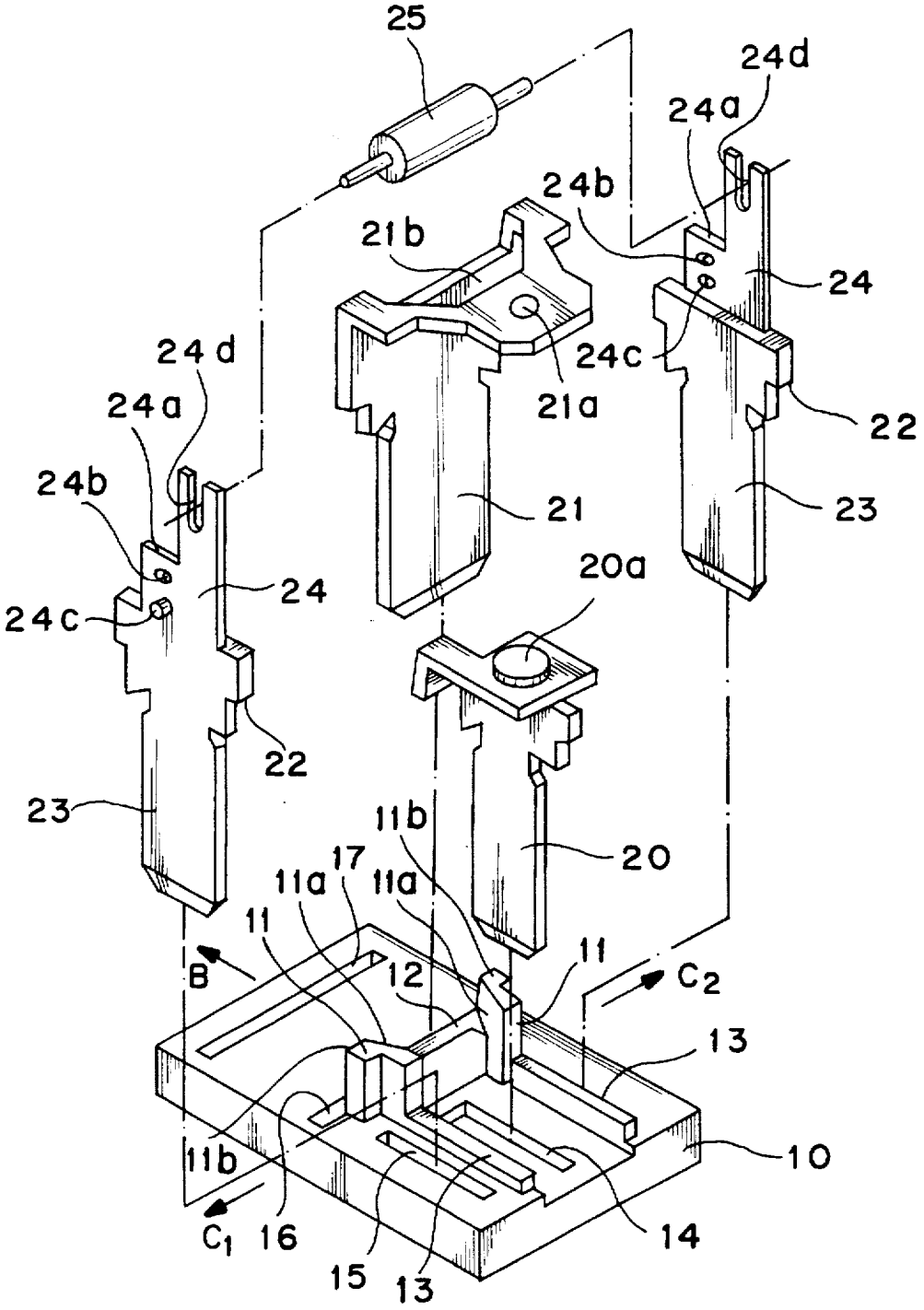
FIG. 3 is an exploded perspective view of an electromagnetic relay of the invention illustrating the assembly of the fixed contact terminals and the coil terminal with respect to the base.

The base 10, which is shown in FIG. 3, has two projections 11 that rise from the middle of the upper surface of the base. Between projections 11 extends a low wall 12 that serves both to insulate and position the components. The ends of the opposing surfaces of the projections 11 taper into segments 11*a* that come in contact with and control the position of the end of a movable metal armature 44 in directions $C_1$ and $C_2$. Segments 11*b* control the position of the armature 44 in direction B. From the base of each projection 11 extends a low insulation curb 13.

Between insulation curbs 13 is an L-shaped groove for one of the fixed contact terminals. At the base of each of the curbs 13 is a groove for one of the coil terminals. (The groove on the far side of the relay is not pictured in FIG. 3.) Another groove 16 is provided at the base of the wall 12 for one of the fixed contact terminals. At a specified distance from the groove 16 is a parallel groove 17 for the movable contact terminal.

The first fixed contact terminal 20 is pressed so that one end is bent to horizontal and has a fixed contact 20*a* positioned on it. The second fixed contact terminal 21, when viewed laterally, has the shape of an upside-down L. It too has a fixed contact 21*a* on its horizontal end. A portion of the terminal along its bend is removed to form aperture 21*b*.

The coil terminal 22 includes a thicker portion 23, which is the actual terminal that is pressed into the base 10, and a thinner portion 24, which is a connector extending from the top of terminal 23. Approximately half of one side of the connector 24 is cut away to form a ledge 24*a*. Under this ledge 24*a*, in a vertical array, are a through hole 24*b* and a projection 24*c*. A slit 24*d* is cut into the top of the remaining half of the connector for an electrical connection.

The first fixed contact terminal 20 is pressed into a groove 14 in the base 10 and caulked in place. The second fixed contact terminal 21 is pressed into a groove 16 until it comes in contact with the upper surfaces of the projections 11. When the second fixed contact terminal 21 is caulked in place, the two fixed contacts 20*a* and 21*a* face each other across a specified interval.

The coil terminal 22 is pressed from above into the groove 15 at the base of the curb 13 in the base 10 and caulked in place. An electrical element 25, such as a resistor, diode or the like, is pressed into slits 24*d* and electrically connected. The purpose of electrical element 25 is to mitigate the effect of surge voltage generated by the coil 34 on the user's circuit.

Figure 6:
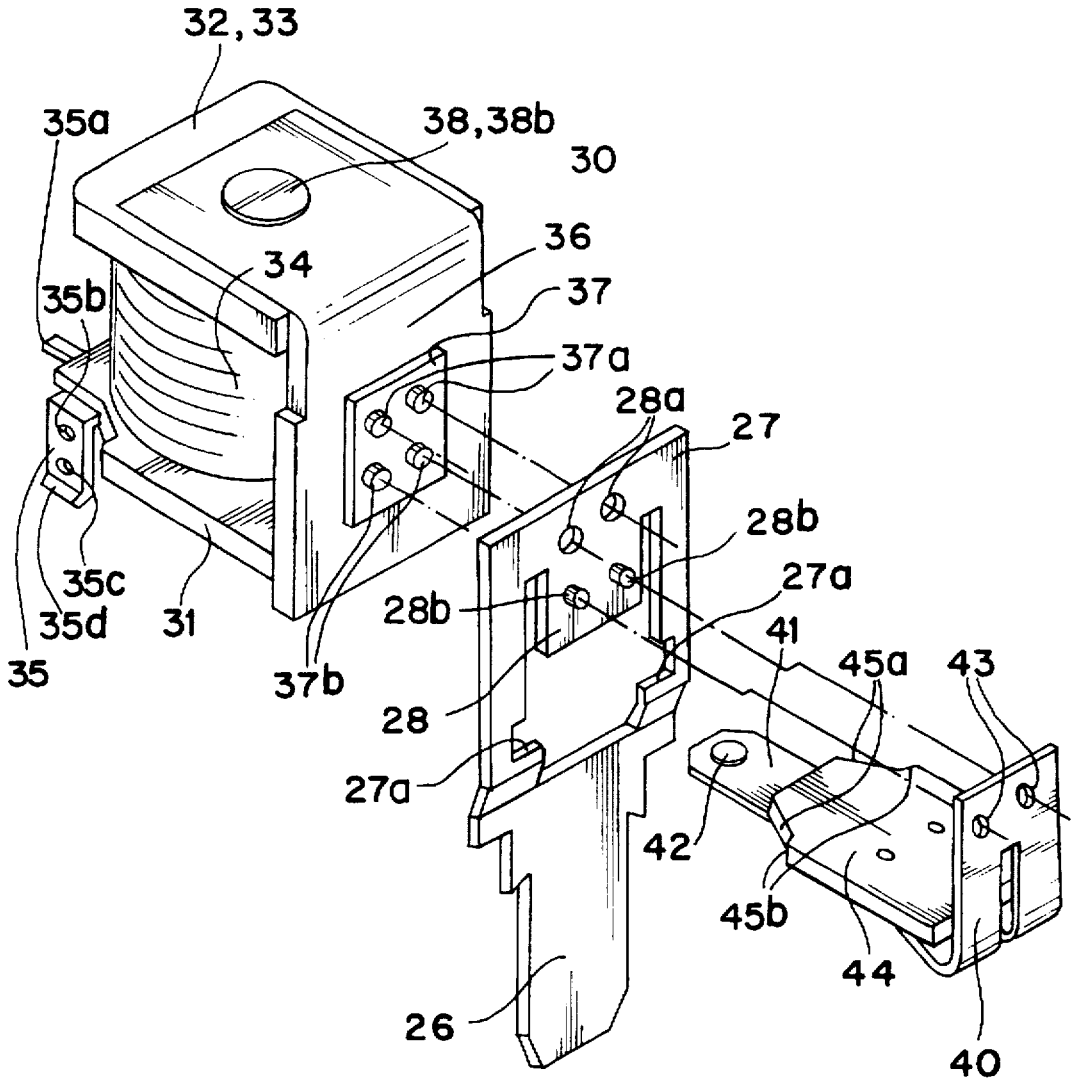
FIG. 6 is an exploded perspective view illustrating assembly of the movable contact terminal and the hinged spring with respect to the block.

The movable contact terminal 26, as shown in FIG. 6, is formed integrally with its connector 27, which is the roughly gate-shaped portion on its upper end. On the inner portion of the connector 27 are two notches 27*a* which face each other to position the hinged spring 40. A tongue 28 that extends downward from the upper portion of the inner edge of the connector 27 has two through holes 28*a* and two projections 28*b* below them.

In the electromagnetic block 30, the coil 34 is wound around the central portion (not pictured) of the spool 33 that surrounds a core 38. On the end rims of the spool 33 are two copper portions 31 and 32. The wire, which is drawn out from the spool, is tied and soldered to a post 35*a* on a connecting strip 35, which is provided on the rim 31. A yoke 36 is attached to the core 38.

The connecting strip 35 has two through holes 35*b* and 35*c*. The lower edge 35*d* of the connecting strip 35 is bent slightly outward. This edge is pressed into a slit (not depicted) in the rim 31 to hold the connecting strip 35 in position.

Figure 7A:
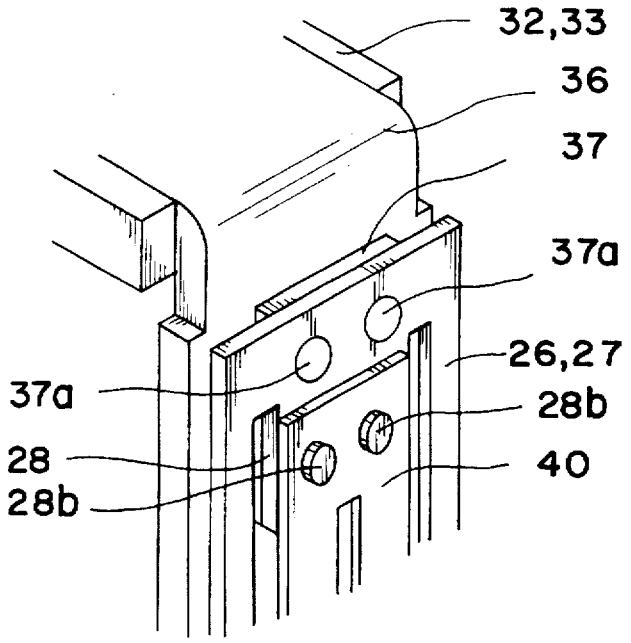
FIG. 7(*a*) is a perspective view of the hinged spring.
Figure 7B:
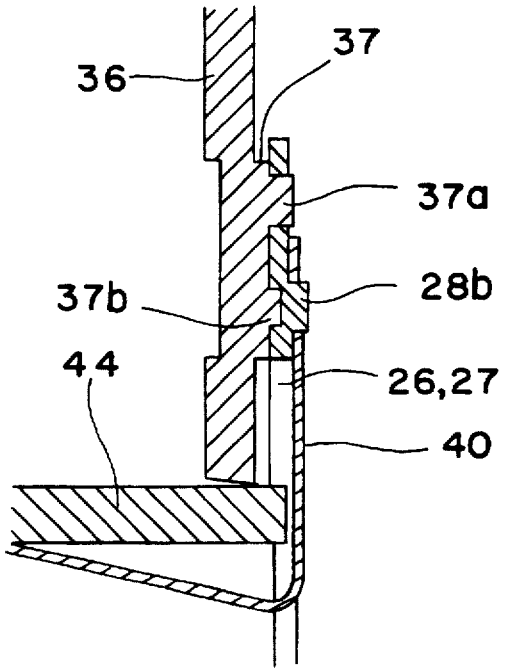

Referring to FIG. 7(*a*) and 7(*b*), the yoke 36 is bent at a substantially right angle. On the rear surface of its vertical portion is a flat protruding segment 37 that serves as a spacer according to the first embodiment of the invention. From the surface of the segment 37 protrude two sets of lugs 37*a* and 37*b*, each of which is arrayed along a vertical line. These lugs are formed by an ejection process.

The lugs 37*a* on the flat protruding segment 37 of the yoke 36 are configured to engage the through holes 28*a* in the movable contact terminal 26. To position the yoke, the lugs 37*b* on the yoke engage in the depressions on the rear side of the movable contact terminal 26, which correspond to the lugs 28*b* on the front side of the movable contact terminal. The lugs 37*a* are then caulked in place.

In this embodiment, the yoke 36 is held in place not only by lugs 37*a* on the yoke, which engage in through holes 28*a* in the movable contact terminal 26, but also by lugs 37*b* on the yoke, which engage in the depressions on the rear side of the movable contact terminal 26 made when the lugs 28*b* are created. The movable contact terminal 26 is thus held in position at four separate places on the yoke 36. This prevents the movable contact terminal from rattling and increases the precision that can be achieved in the assembly process.

Next, the installation hole (not pictured) in the yoke 36, which is integral to the movable contact terminal 26, is positioned so that it is coaxial with the central hole (also not pictured) in the copper portion of the spool 33 of the electromagnetic block 30. The core 38, whose cross section resembles the letter T, is inserted in this hole. One of its protruding ends serves as a pole 38*a*, the other protruding end 38*b* is caulked in place to produce an electromagnetic block 30 with a movable contact terminal 26.

In this embodiment, the movable contact terminal 26 is fixed to the yoke 36 by means of a flat protruding segment 37. This insures that there will be no gap between the two so that heat will be radiated efficiently.

Furthermore, the upper end of the movable contact terminal 26 is caulked to the approximate center of the vertical surface of the yoke 36. This arrangement lengthens the distance between the yoke 36 and the lower end of the movable contact terminal 26 so as to reduce the amount of heat which is transmitted.

In the embodiment discussed above, a total of four lugs 37*a* and 37*b* are used on a single flat protruding segment 37. However, the invention is by no means limited to this design only. It would be equally acceptable to use a single lug on one flat protruding segment or to use two lugs on one segment.

Also, in this embodiment, the movable contact terminal 26 is caulked to the yoke 36. The invention is not limited to this design. The movable contact terminal 26 could as well be welded or screwed to the yoke.

Further, in the embodiment discussed above, a specified interval is created between the yoke and the movable contact terminal by forming a flat protruding segment 37 on the yoke 36. The invention is not limited to this design only. An interval could also be created by using a discrete spacer on the yoke 36 or by employing an ejection or bending process on the movable contact terminal 26.

Figure 4:
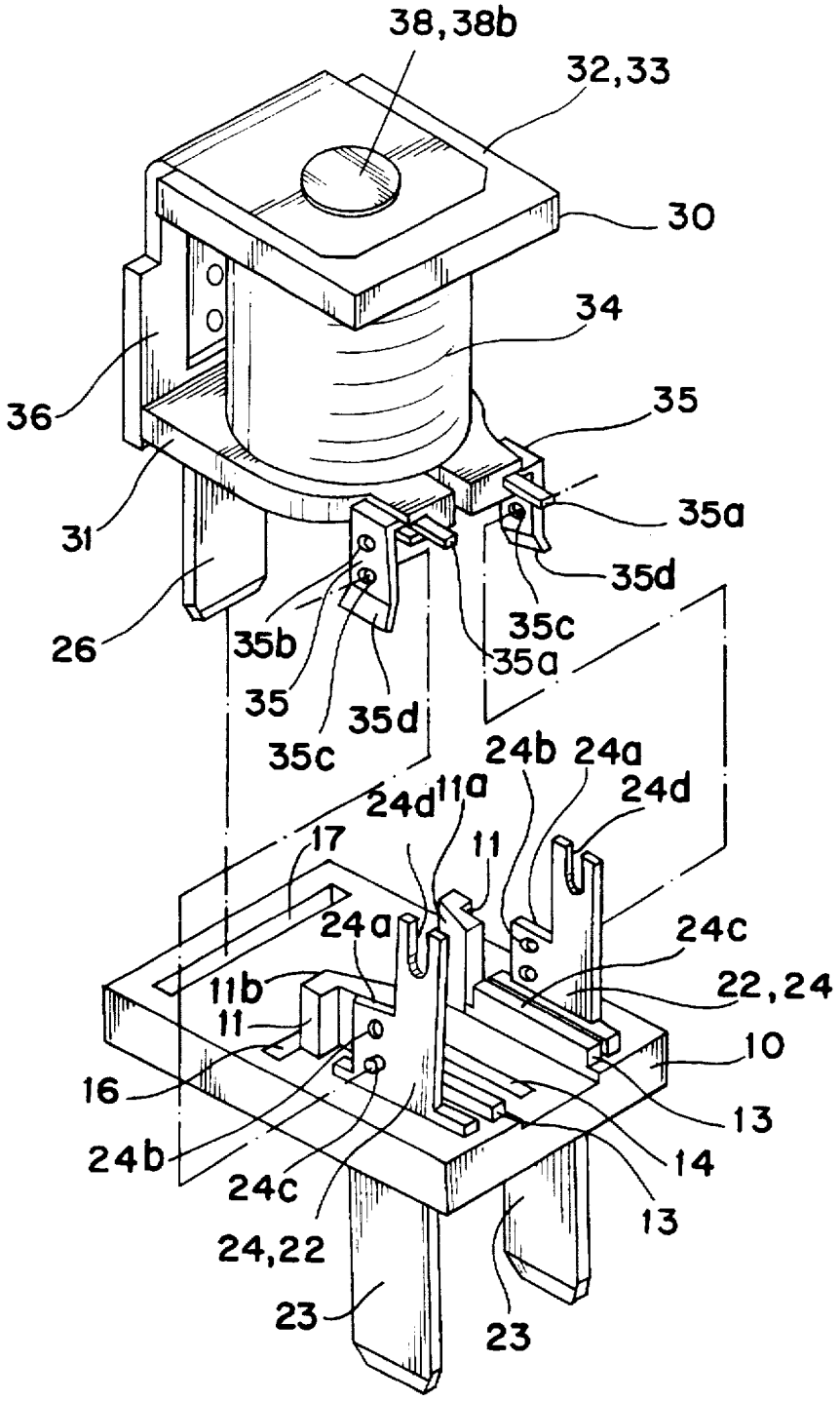
FIG. 4 is an exploded perspective view of an electromagnetic relay of the invention illustrating the assembly of the electromagnetic block with respect to the base.

The electromagnetic block 30, once assembled with the movable contact terminal 26, is positioned from above on the base 10, on which are installed the fixed contact terminals 20 and 21 and the coil terminal 22. The movable contact terminal 26 is forced into the slit 17 in the base 10. The rim 31 of the spool 33 is held in position by the upper surfaces of projections 11 coming in contact with the fixed contact terminal 21. The connecting strip 35 on the rim 31 comes to rest on the ledges 24*a* of the coil terminals 22, which hold them in position, as shown in FIG. 4. For clarity, the fixed contact terminals 20 and 21 are not shown in FIG. 4.

Figure 5C:
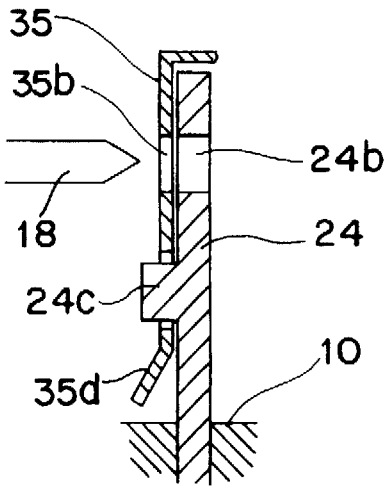
FIGS. 5(*a*), 5(*b*) and 5(*c*) are cross sections illustrating assembly of the electromagnetic block of the invention.
Figure 5B:
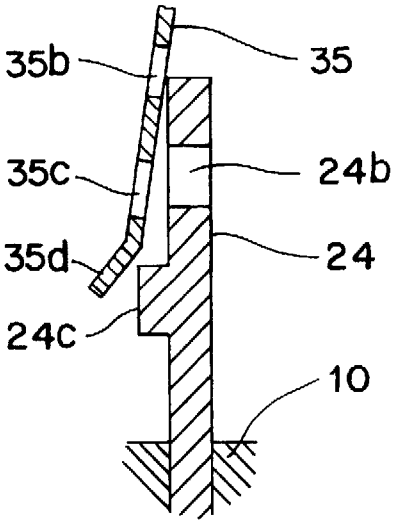
Figure 5A:
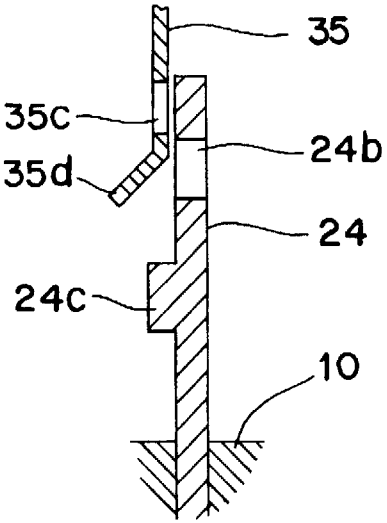

When the electromagnetic block 30 is pushed downward, as shown in FIG. 5, the lower edges 35*d* of the connecting strip 35, which are bent outward, travel downward along the outer surfaces of the coil terminals 22 past the projections 24*c*. Holes 35*c* in the terminal strips engage with projections 24*c* on the coil terminals 22. Holes 35*b* in the connecting strip 35 line up with the through holes 24*b* in the coil terminals 22. Jig pins 18 are inserted through the holes 24*b* and 35*b* to hold the block in position. The projections 24*c* are caulked to complete the assembly of the electromagnetic block 30. Since in this embodiment the block is held in position simply by the insertion of jig pins 18 through the holes 24*b* and 35*b*, the task of positioning the block is simplified.

The projections 24*c* on the coil terminals 22 are formed by being pressed out with great force, so their reverse surfaces are flat. This obviates the need to use pins corresponding to the shape of the projection to receive the caulking.

In a second embodiment, the hinged spring 40, as shown in FIG. 6, is made from a thin plate of conductive spring material that is bent into an L shape. On the end of the movable head 41, which extends from the horizontal portion of the hinged spring 40, is a movable contact 42. A movable metal armature 44, which rests on the base of the horizontal portion of the hinged spring, is caulked in place. In the upper portion of the vertical segment of the hinged spring 40 are two through holes 43 which will be used for caulking. Tapered surfaces 45*a* and edges 45*b* are formed by cutting away a portion of the end of the movable metal armature 44.

The end of the movable head 41 is inserted through the aperture in the connector 27 on the movable contact terminal 26, which is now attached to the base 10, and through the aperture 21*b* in the fixed contact terminal 21 (FIG. 3). When the through holes 43 in the hinged spring 40 are made to engage with lugs 28*b* on the movable contact terminal 26 and caulked in place (FIG. 7(*a*)), the end of movable metal armature 44 is supported with the lower surface of the yoke 36 as its fulcrum so that the armature 44 can rotate (FIG. 7(*b*)). The other end of movable metal armature 44 faces the pole 38*a* of the core 38 and can come in contact with the pole or move away from it. The movable contact 42 on the movable head 41 faces the fixed contacts 20*a* and 21*a* and comes into contact with these two fixed contacts alternatively.

The case 50 is made to engage with the base 10 as the final step in the assembly process.

In this embodiment, as can be seen in FIG. 7(*b*), lugs 37*b* on the yoke 36 engage in the depressions which are the inverse surface of lugs 28*b* on the movable contact terminal 26. This arrangement insures that lugs 28*b* will remain imperturbable. When the aforesaid lugs 28*b* are caulked in place, there is no possibility that they will collapse, and it is more probable that the caulking will remain stable.

In this embodiment, the hinged spring 40 is caulked to the movable contact terminal 26. It would be equally acceptable to weld or screw the spring to the movable contact terminal.

The following describes the operation of an electromagnetic relay configured as described above. When voltage is not applied, the coil 34 in the electromagnetic block 30 is not magnetized, and the spring force of the hinged spring 40 causes the movable metal armature 44 to be pushed downward. The movable contact 42 is in contact with the first fixed contact 20*a*.

When voltage is applied to magnetize the coil 34, the magnetic pole 38*a* of the core 38 attracts the movable metal armature 44, which rotates in opposition to the force of the hinged spring 40. The movable head 41 rotates with the armature 44, and the movable contact 42 moves away from the first fixed contact 20*a* and goes over to the second fixed contact 21*a*. The movable metal armature 44 is pulled into contact with the pole 38*a* of the core 38 (FIG. 1).

When the voltage is removed, the spring force of the hinged spring 40 causes the movable metal armature 44 to revert to its original position, and the movable contact 42 switches back to the first fixed contact 20*a*.

Figure 8:
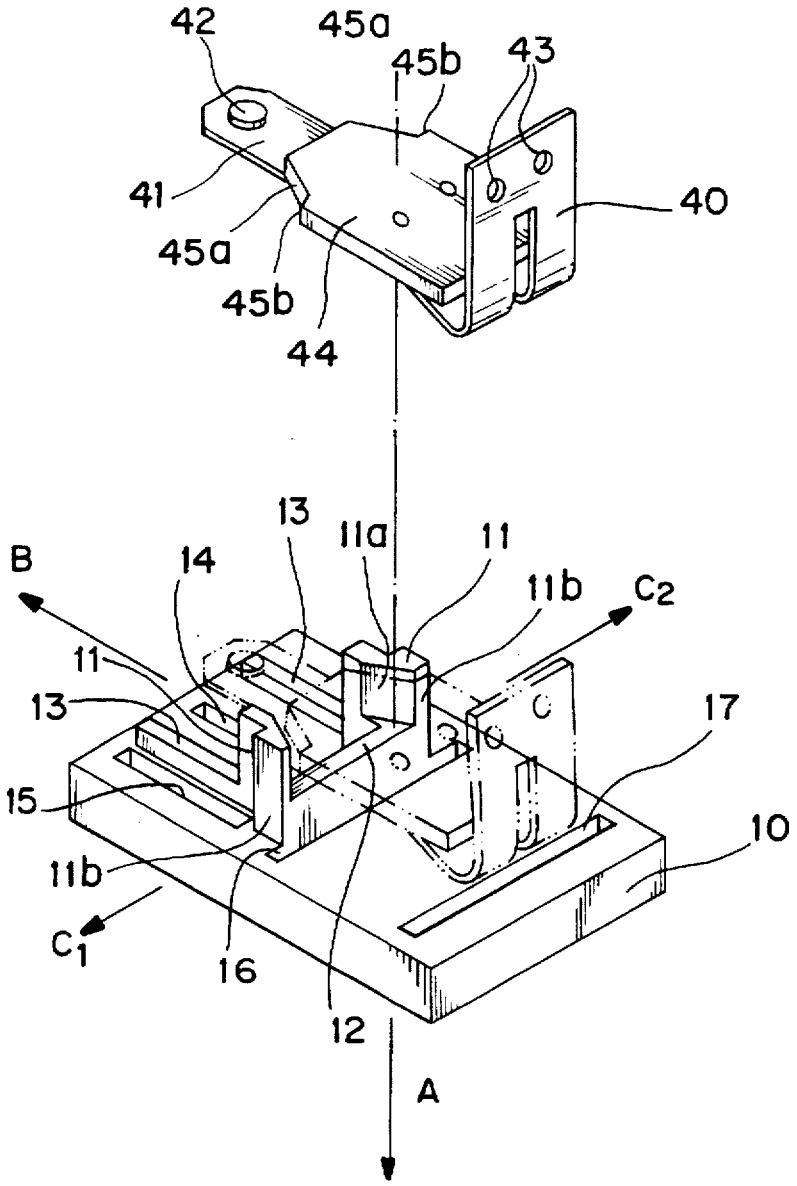
FIG. 8 is an exploded perspective view illustrating assembly of the hinged spring onto the base.
Figure 9B:
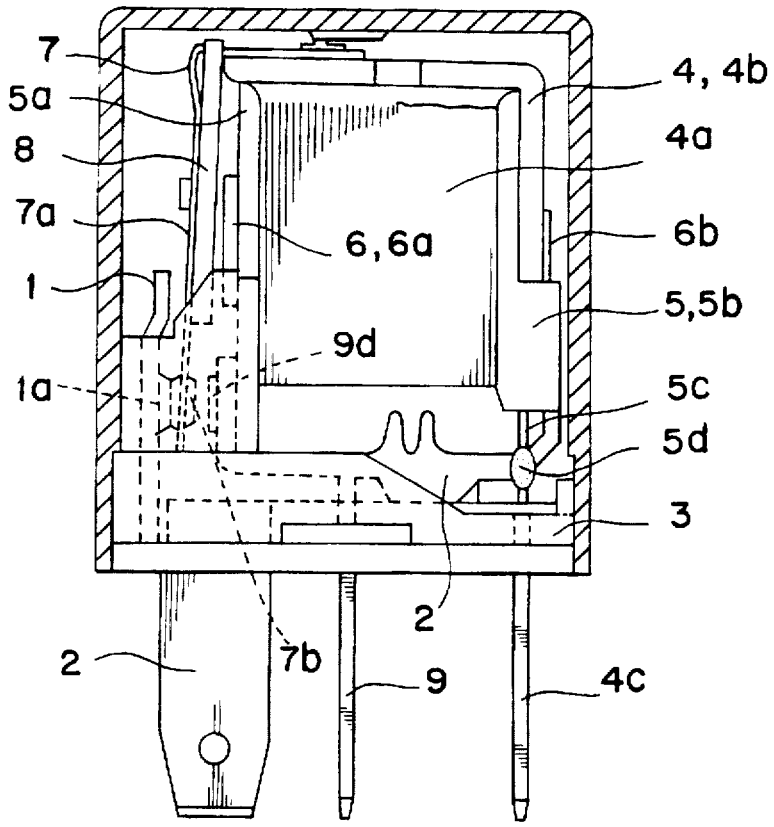
FIG. 9(b) PRIOR ART
FIG. 9(*a*) is a left side cross section of a prior art electromagnetic relay.
Figure 9A:
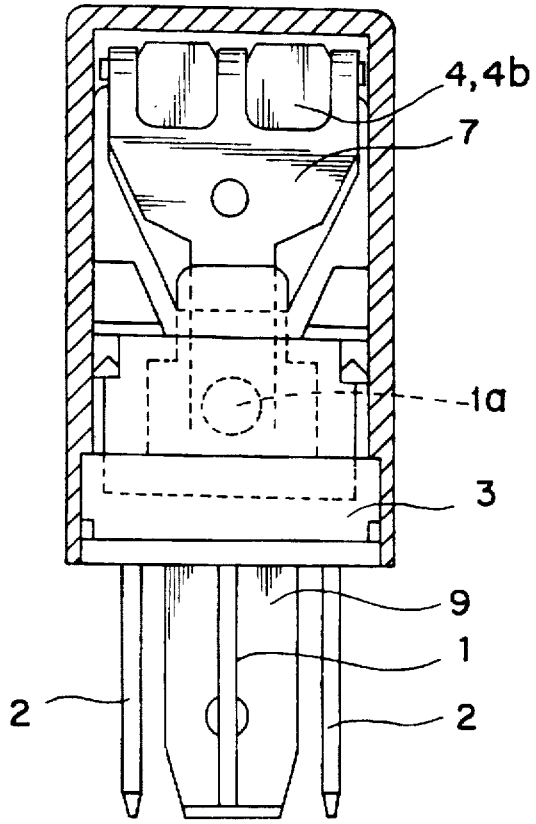
FIG. 9(a) PRIOR ART
Figure 10:
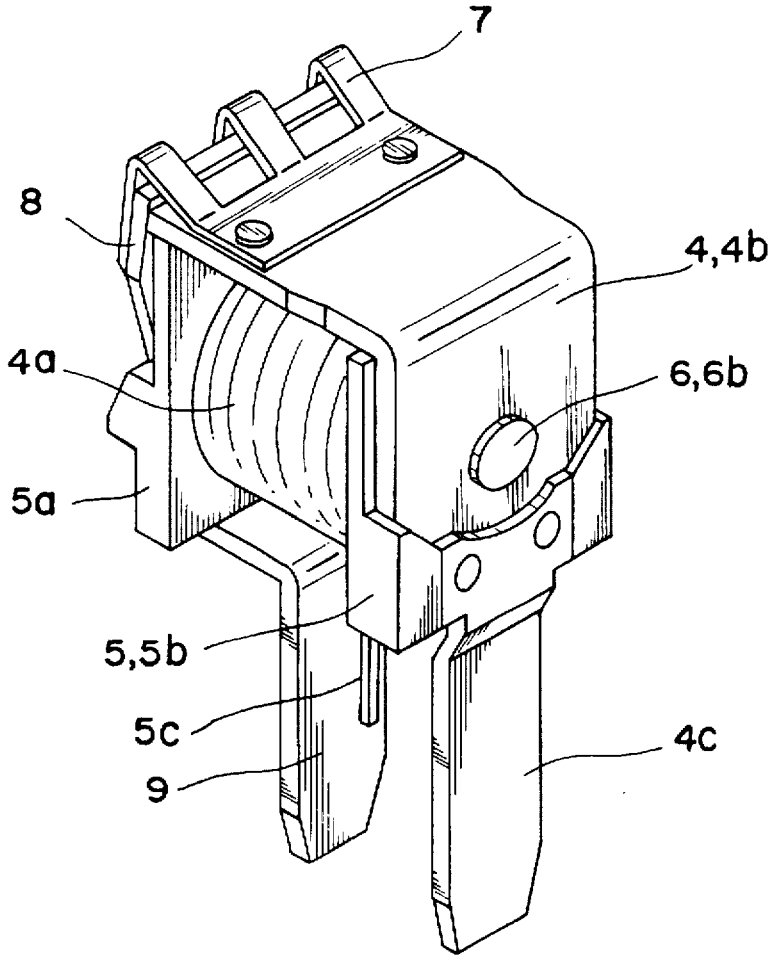
FIG. 10 PRIOR ART
FIG. 10 is a perspective drawing of the electromagnetic block in a prior art relay.

If, as shown in FIG. 8, a small impact load is applied to the movable metal armature 44 in the direction indicated by arrow A, the end of the movable metal armature 44 will be stopped by notches 27*a* in the movable contact terminal 26 so that the hinged spring 40 will not experience plastic deformation.

If a larger impact load is applied in the direction indicated by arrow A, the movable metal armature 44, mediated by the movable head 41, will come in contact with the upper surface of the wall 12. The angle of rotation of the movable metal armature 44 is prevented from increasing infinitely, and just as above, the operating characteristics of the hinged spring 40 will not be affected by plastic deformation.

It would also be acceptable for the movable metal armature 44 to make contact through the head 41 with the upper surface of the wall 12 at the same time that it engages with the notches 27*a* in the movable contact terminal 26.

If an impact load is applied to the movable metal armature 44 in the direction indicated by arrow B, edges 45*b* on the end of the movable metal armature 44, which faces direction B, will engage with surfaces 11*b* on the projections 11. This will limit the travel of the movable metal armature 44 in direction B, thereby preventing the operating characteristics of the relay from being affected by the plastic deformation of the hinged spring 40.

If an impact load is applied to the movable metal armature 44 in the directions indicated by arrows $C_1$ and $C_2$, tapered surfaces 45*a* on the end of the movable metal armature 44 will come in contact with tapered surfaces 11*a* on the projections 11. This will limit the travel of the movable metal armature 44 in directions $C_1$ and $C_2$, thereby preventing the operating characteristics of the relay from being affected by the plastic deformation of the hinged spring 40.

In this embodiment, the opposed surfaces of the projections 11 are tapered to form surfaces 11*a*, which serve as a guide for the movable metal armature 44.

Since projections 11 and the low wall are not formed separately on the base 10 but are provided as an integral piece, their shape and construction are simplified.

In the embodiments we have been discussing, the projections 11 on the base 10 and the end of the movable metal armature 44 are both tapered. However, the invention is by no means limited to this design only. It would be equally acceptable to limit the travel of the movable metal armature 44 in directions B, $C_1$ and $C_2$ by having the opposed surfaces of projections 11 take the form of right angles and providing the end of the movable armature with a corresponding shape.

As should be clear from the above explanation, the first embodiment of this invention has a spacer between its external connector terminal and its yoke. This has the effect of creating a space between the yoke and the terminal so that the heat from the electromagnetic block can be radiated more readily. More specifically, if the upper end of the external connector terminal is fixed to the approximate center of the vertical surface of the yoke with a spacer between the two, the distance from the yoke to the end of the external connector terminal will be made longer. The heat generated by the electromagnetic block will be less likely to be transferred to the user's connector, and the permissible range of temperatures for the connector will not be exceeded.

In the second embodiment of this invention, a hinged spring used as the site of the movable contact is directly attached and electrically connected to a movable contact terminal which is fixed to the yoke. It is not, as in the prior art, electrically connected through the yoke, which consists of iron, a material with high electrical resistance. The result is that the conductive circuit has lower resistance than those of relays belonging to the prior art.

Other embodiments are within the scope of the following claims.

What is claimed is:

1. An electromagnetic relay, comprising:

a base;

a fixed contact terminal attached to the base, the fixed contact terminal having a fixed contact;

an electromagnetic block attached to the base, the electromagnetic block having a yoke;

a movable contact terminal attached to the yoke;

a coil terminal electrically connected to the electromagnetic block;

a hinged spring attached to the movable contact terminal;

a movable metal armature attached to the hinged spring;

a movable head attached to the movable metal armature;

a movable contact formed integrally with the movable head; and a flat protruding segment between the yoke and the movable contact terminal, wherein the flat protruding segment is a spacer.

2. An electromagnetic relay according to claim 1, wherein the flat protruding segment is formed on the yoke.

3. An electromagnetic relay according to claim 1, wherein the flat protruding segment is formed on the movable contact terminal.

4. An electromagnetic relay according to claim 1, wherein the flat protruding segment is formed on the hinged spring.

5. An electromagnetic relay according to claim 1, wherein the coil terminal is connected to the electromagnetic block by a connecting strip.

6. An electromagnetic relay, comprising:

a base, a fixed contact terminal attached to the base, the fixed contact terminal having a fixed contact, an electromagnetic block attached to the base, the electromagnetic block having a yoke, the yoke having a first lug, a movable contact terminal having a first hole and a second lug, the first hole for attaching the movable contact terminal to the yoke by engaging the first lug through the first hole, a coil terminal electrically connected to the electromagnetic block, a hinged spring having a second hole for attaching the hinged spring to and directly electrically connecting with the movable contact terminal by engaging the second lug through the second hole, a movable metal armature attached to the hinged spring, a movable head attached to the movable metal armature, and a movable contact formed integrally with said movable head.

* * * * *